US005132697A

United States Patent [19]

Tan

[11] Patent Number: 5,132,697

[45] Date of Patent: Jul. 21, 1992

[54] INSULATED CLASP FOR A WRIST BAND LOOP ANTENNA

[75] Inventor: Wei L. Tan, Lake Worth, Fla.

[73] Assignee: Motorola, Inc., Schaumburg, Ill.

[21] Appl. No.: 745,963

[22] Filed: Aug. 12, 1991

Related U.S. Application Data

[63] Continuation of Ser. No. 558,951, Jul. 27, 1990, abandoned.

[51] Int. Cl.[5] ..... H01Q 1/12

[52] U.S. Cl. ..... 343/718; 455/351

[58] Field of Search ..... 343/718, 866, 868; 455/351

[56] References Cited

U.S. PATENT DOCUMENTS

| | | | |
|---|---|---|---|
| 3,032,651 | 5/1962 | Stahli et al. | 455/231 |
| 4,480,253 | 10/1984 | Anderson | 340/825 |
| 4,713,808 | 12/1987 | Gaskill et al. | 370/94 |
| 4,754,285 | 6/1988 | Robitaille | 343/718 |
| 4,769,656 | 9/1988 | Dickey | 343/718 |
| 4,873,527 | 10/1989 | Tan | 343/718 |
| 4,922,260 | 5/1990 | Gaskill et al. | 343/718 |

FOREIGN PATENT DOCUMENTS

| | | | |
|---|---|---|---|
| 0100639A2 | 2/1984 | European Pat. Off. . | |
| 58-53232 | 3/1983 | Japan | 343/718 |
| 1-50626 | 2/1989 | Japan | 343/718 |

*Primary Examiner*—Michael C. Wimer
*Assistant Examiner*—Hoanganh Le
*Attorney, Agent, or Firm*—Philip P. Macnak; Vincent B. Ingrassia; William E. Koch

[57] ABSTRACT

A wrist band loop antenna for a device having a receiver which is intended to be worn on a wearer's wrist comprises a pair of wrist band loop segments which are coupled to the receiver for forming first and second electrical portions of the wrist band loop antenna. A conductive clasp couples to the first and second wrist band loop segments to provide adjustment of the length of the wrist band and provides electrical coupling between first and second wrist band loop segments to form the wrist band loop antenna. An insulator is provided to insulate the conductive clasp from the wearer's wrist which is coupled to the lower surface of the clasp.

8 Claims, 3 Drawing Sheets

INSULATED CLASP FOR A WRIST BAND LOOP ANTENNA

This is a continuation of application Ser. No. 07/558,951, filed Jul. 27, 1990, now abandoned.

BACKGROUND OF THE INVENTION

1, FIELD OF THE INVENTION

The present invention relates generally to the field of antennas for miniature portable communication devices, and more particularly to a wrist band antenna having an insulated clasp which provides electrical continuity for the antenna.

2. DESCRIPTION OF THE PRIOR ART

Miniature portable communication devices, such as wrist worn receiving devices, have generally incorporated the receiving antenna within the wristband, due largely to the lack of physical space within the housing of the wrist worn receiver for locating the antenna. When the antenna has been incorporated within the wristband, the antenna has often been constructed in two sections to allow easy removal of the device from the wrist. This has, as a result, required the use of a conductive clasp to provide both adjustability and to provide the electrical connection required to complete the antenna loop when the wrist worn receiving device was fastened to the wrist. While such a wrist band loop antenna has been found to, in most instances, deliver adequate performance, it has been recently found that the performance of the wrist band loop antenna is being significantly reduced when the conductive clasp is in contact with the wearer's wrist.

SUMMARY OF THE INVENTION

It is an object of the present invention to provide a wrist band antenna which provides improved antenna performance.

It is a further object of the present invention to provide a wristband loop antenna which minimizes the interaction of the antenna with the wearer's wrist.

These and other objects of the invention are achieved by providing a wrist band loop antenna for a device having a receiver which is enclosed in a housing and which is intended to be worn on a wrist. The wrist band loop antenna comprises first and second wrist band loop segments which are coupled to the receiver housing and to the for forming portions of the wrist band loop antenna. A conductive clasp having a first clasp portion couples to the first wrist band loop segment and a second clasp portions couples to the second wrist band loop segment to provide adjustment of the length of the wrist band and provides electrical coupling between first and second wrist band loop segments to form the wrist band loop antenna. The second clasp portion includes a lower surface positioned substantially adjacent to and in contact with the wrist. An insulator is provided which is coupled to the lower surface of the conductive clasp to insulate the conductive clasp from the wrist when the device is attached to the wrist.

BRIEF DESCRIPTION OF THE DRAWINGS

The features of the invention which are believed to be novel are set forth with particularity in the appended claims. The invention itself, together with its further objects and advantages thereof, may be best understood by reference to the following description when taken in conjunction with the accompanying drawings, in the several figures of which like reference numerals identify identical elements, in which, and wherein:

DESCRIPTION OF THE PREFERRED EMBODIMENTS

Figure 1:
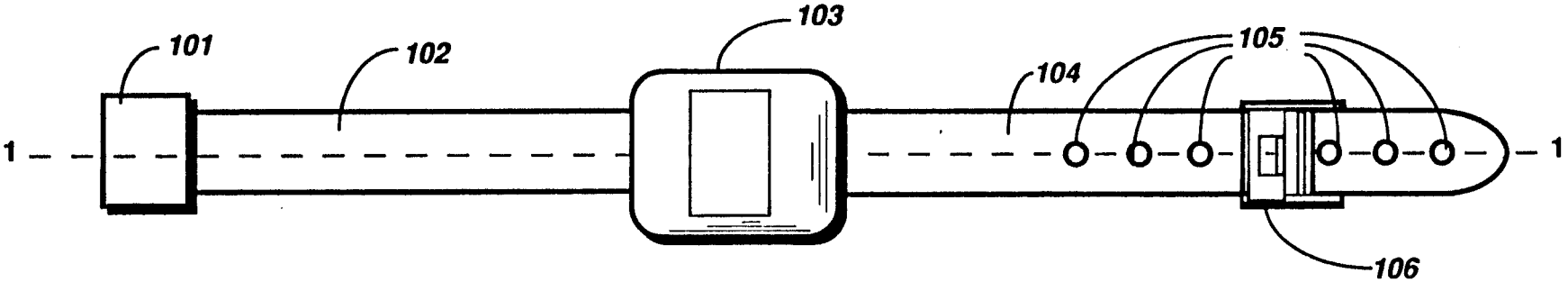
FIG. 1 is a top view of a wrist worn receiving device having a wristband loop antenna utilizing the insulated clasp of the present invention.
Figure 2:
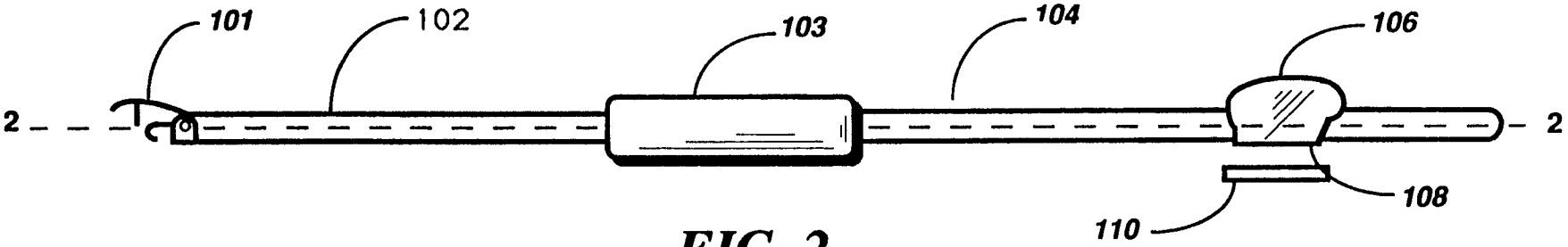
FIG. 2 is a side view of the wrist worn receiving device having a wristband loop antenna utilizing the insulated clasp of the present invention.

Referring to the figures, FIGS. 1 through 4 illustrate the wrist worn receiving device having a wristband loop antenna utilizing the insulated clasp of the present invention. Referring to FIGS. 1 and 2 the wrist worn receiving device comprises a wrist strap portion 102 coupled at one end to the housing 103 of the receiving device, and coupled at the opposite end to a clasp locking assembly 101. A first conductor, not shown, is located within the wrist strap portion 102, coupling between the receiver enclosed within the device housing 103 and the clasp locking assembly 101 to form a first portion of the device loop antenna. A second wrist strap portion 104 is also connected at one end to the housing 103 of the receiving device. A second conductor, not shown, is located within the second wrist strap portion 104, coupling to the receiver enclosed within the device housing 103 at one end. The conductor is exposed at a plurality of selectable positions 105 along the second wrist strap portion 104 to provide selectable contacts with the second conductor forming a second portion of the device loop antenna. A moveable clasp assembly 106 is slideably attached to the opposite end of the wrist strap portion 104. By adjusting the position of the moveable clasp assembly 106 with respect to the plurality of selectable positions 105, the length of the wristband is adjusted, and electrical contact between the clasp and the second conductor is provided. For a complete description of the construction and operation of the wrist band loop antenna, reference is directed to U.S. Pat. No. 07/299,276 filed Jan. 23, 1989 to Tan et al, entitled "Reactance buffered Loop Antenna and Method for Making the Same" which is assigned to the assignee of the present invention, and which is incorporated by reference herein. The reactance buffered loop antenna of Tan et al. may be further combined with a ferrite loop antenna located within a portion of the housing provided for the wrist worn receiving device. Such an antenna combination is described in U.S. Pat. No. 4,873,527 issued Oct. 10, 1989 to Tan, entitled "Antenna System for a Wrist Carried Paging Receiver" which is also assigned to the assignee of the present invention, and which is incorporated by reference herein. When the wrist strap loop antenna is combined with a ferrite loop antenna, as described by Tan, the antenna sensitivity is enhance while the body effects due to hand movements are minimized.

Figure 3:
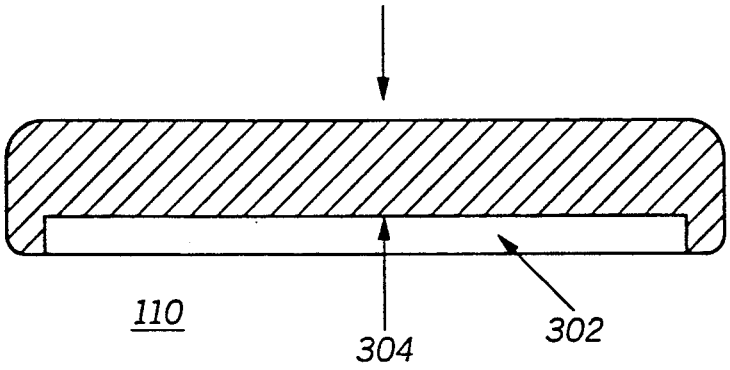
FIG. 3 is a cross sectional view of the clasp insulator of the present invention.
Figure 4:
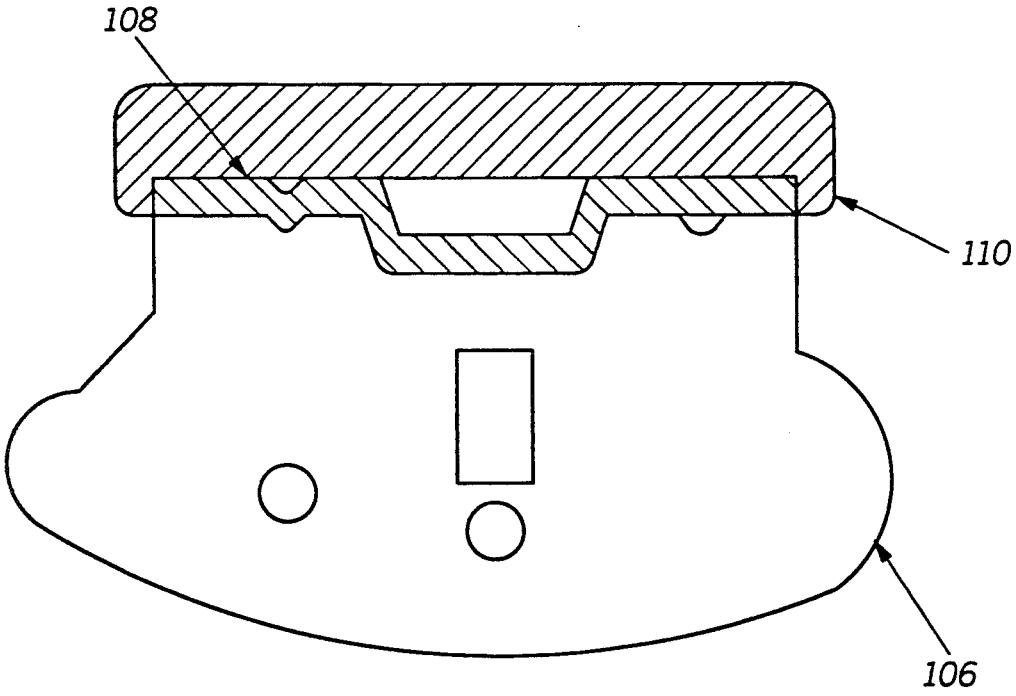
FIG. 4 is a cross sectional view of the clasp and clasp insulator of the present invention.

In the preferred embodiment of the present invention, a clasp insulator 110 is affixed to the lower surface 108 of the moveable clasp assembly 106, as shown in FIG. 2, positioning the insulator between the moveable clasp assembly and the wearer's wrist. The function of the clasp insulator will be described in detail below. In the preferred embodiment of the present invention, the clasp insulator has a cross section as shown in FIG. 3. The clasp insulator is preferably molded from a non-conductive plastic material, such as the ABS plastic Cycolac-T ® which is a registered trademark of Borg Warner. The plastic material is preferably pigmented to match the color of the wrist band straps, thereby enhancing the esthetic appeal. It will be appreciated that other non-conducting moldable plastic materials may be utilized as well to implement the clasp insulator 110. The clasp insulator is molded with a cavity 302 which completely surrounds the lower surface of the moveable clasp assembly. The depth of the cavity is equal to the material thickness used to form the moveable clasp assembly lower surface. The molded cavity is rectangular corresponding to the dimensions of the moveable clasp assembly lower surface. The thickness 304 of the insulator is preferably 0.040 inches, resulting in only a minimal increase in the thickness of the moveable clasp assembly lower surface which comes into contact with the wearer's wrist. The corners of the plastic insulator are radiused so as not to irritate the wearer's wrist. As shown in the cross sectional view of FIG. 4, the molded clasp insulator 300 is attached to the lower surface of the moveable clasp assembly using an adhesive, such as a cyanoacrylate adhesive. It will be appreciated, the actual adhesive utilized is a function of the insulator material and the surface finish or plating provided on the moveable clasp assembly. It will also be appreciated other forms of attachment, such as mechanical attachment configurations may be utilized as well.

It will be appreciated the lower portion of the moveable clasp assembly 106, which is formed from sheet metal, may also be formed from a plastic material, such as a molded plastic part having lower surface dimensions substantially the same as the clasp insulator, thereby eliminating the need for a separate clasp insulator which must be attached with an adhesive as described above.

Figure 5:
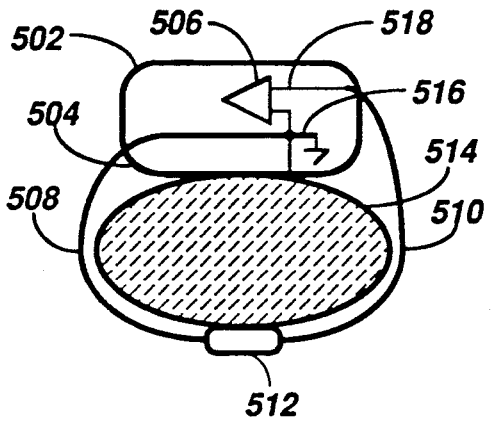
FIG. 5 is a simplified electrical block diagram of a wrist worn receiving device having a wristband loop antenna which is used to described the operation of the insulated clasp of the present invention.

FIG. 5 is a simplified electrical block diagram of a wrist worn receiving device having a wristband loop antenna which is used to described the operation of the insulated clasp of the present invention. The wrist worn receiving device is contained within the device housing 502 which is held to the wearer's wrist by the wrist band antenna comprising a first wrist band section 508, a second wrist band section 510 and the conductive clasp 512. The first wrist band section 508 couples the antenna into the device housing 502 to one input of the radio frequency (RF) amplifier 506, which as shown is the RF amplifier signal ground input 516. The second wrist band section 510 couples the antenna into the device housing 502 to the second input of the radio frequency (RF) amplifier 506, which as shown is the RF amplifier signal input 518. The RF amplifier signal ground 516 also couples to the back cover 504 of the device housing 502. Interposed within the wrist band antenna loop is the wearer's wrist which may be considered a lossy conductive element 514. It is this lossy conductive element, which under the appropriate conditions, such as during periods of high humidity, or during periods of physical activity when the wearer is sweating, that the conduction through the lossy conductive element 514 increases. Depending upon the conditions, the conduction between the conductive device back cover 504 to the conductive clasp 512 can significantly bypass the signal flow through the first wrist band section 508 antenna conductor, causing the wristband antenna to be detuned. The clasp insulator of the present invention significantly reduces the signal flow through the lossy conductive element 514, thereby insuring improved antenna sensitivity, and further reduces variations in antenna sensitivity performance when the wrist worn receiving device is worn by different persons exhibiting different skin conditions, and consequently differing levels of antenna sensitivity due to variations in detuning of the wrist band antenna.

Figure 6:
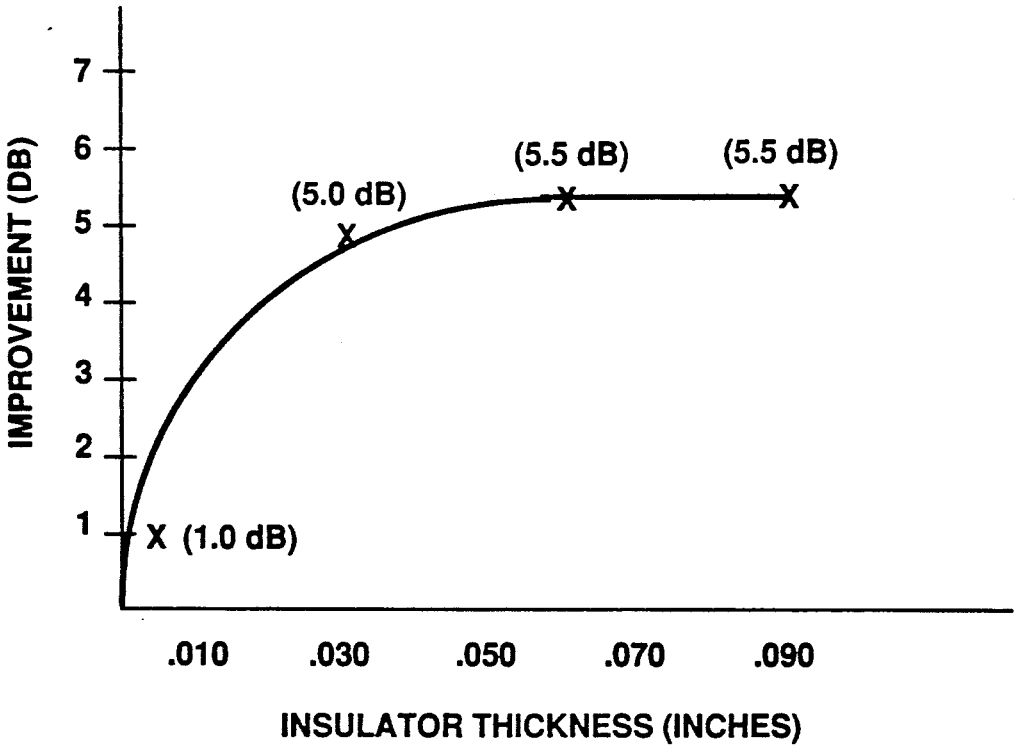
FIG. 6 is a graph showing the wrist band antenna sensitivity improvement for a wrist band loop antenna utilizing the insulated clasp of the present invention.

The actual improvement in antenna sensitivity that can be obtained has been found to be a function of the antenna configuration and the non-conductive material being used for the clasp insulator. When used with the wrist band antenna configuration without the second ferrite loaded antenna, the improvement obtained is more pronounce, due largely to the higher antenna Qs of the wrist band only antenna configuration. FIG. 6 is a graph showing the antenna sensitivity improvement for a wrist band only antenna configuration which was obtained for two insulator materials and a number of insulator thicknesses. The sensitivity improvement measurements were obtained by completely re-tuning the antenna with each insulator configuration with the wristworn device in place on the wearer's wrist. At zero insulator thickness, indicating no insulator is present, the antenna sensitivity is taken as a reference and corresponds to 0 dB (decibel) on the graph of FIG. 6. When only a very thin insulator, such as an electrostatically applied epoxy paint which is applied to the entire bottom surface component of the moveable clasp assembly, the antenna sensitivity improvement obtained was measured to be 1 dB. Measurements of antenna sensitivity improvements of 5 dB, 5.5 dB and 5.5 dB were obtained for insulator thicknesses of 0.030 inch, 0.060 inch, and 0.090 inch, respectively. A 0.030 inch rubber foam tape was applied to the bottom surface of the moveable clasp for each of the successive thickness measurements, and, and previously described, the antenna was re-tuned on the wearer's wrist at each insulator thickness. Although only a single data point is shown for the improvement effected for a non-conductive coating, it will be appreciated, additional improvement in sensitivity would be expected when a thicker non-conductive coating is applied to the clasp. It will also be appreciated a molded insulator is preferable to a non-conductive coating, because the positioning of the insulating material is more readily insured.

Table I below illustrates the antenna sensitivity improvement obtained for a combination wristband loop antenna and ferrite loop antenna which is located within the wrist worn receiver housing. It will be appreciated, the relative improvement observed is less than as illustrated for the wrist band only antenna due to the lower operating Q of the combination antenna.

| Material | Thickness (Inches) | Improvement (dB) Subject 1 | Subject 2 |
|---|---|---|---|
| Polycarbonate | .023 | 2.0 | 1.5 |
| | .030 | 2.5 | 2.5 |
| | .037 | 3.0 | 2.5 |
| Rubber | .030 | 2.5 | 1.5 |

-continued

| Material | Thickness (Inches) | Improvement (dB) Subject 1 | Subject 2 |
|---|---|---|---|
| | .060 | 3.5 | 3.0 |

Table I illustrates that the antenna sensitivity improvement obtained in the lower Q combination antenna, while being less than obtained in the higher Q antenna configuration, is still significant.

In summary a wrist band loop antenna configuration has been described which utilizes two wrist band loop sections which are coupled to a wrist worn receiving device at one end, and to each other at the opposite end through a conductive clasp. A clasp insulator is provided for isolating the clasp from the wearer's wrist. By isolating the conductive clasp from the wearer's wrist, a significant improvement in antenna sensitivity is obtained as compared to not isolating the conductive clasp to the wearer's wrist. In the preferred embodiment of the present invention the clasp insulator is molded from a non-conductive material and affixed to the lower surface of the clasp with an adhesive. In an alternate embodiment of the present invention, an insulating coating of a sufficient material thickness is applied to the conductive clasp.

While specific embodiments of this invention have been shown and described, further modifications and improvements will occur to those skilled in the art. All modifications which retain the basic underlying principles disclosed and claimed herein are with the scope and spirit of the present invention.

I claim:

1. A wrist band loop antenna for a device having a receiver which is intended to be worn on a wrist, comprising:

a housing for enclosing the receiver;

a first and a second wrist band loop segment coupled to said housing and further coupled to the receiver, said wrist band loop segments forming portions of the wrist band loop antenna;

a conductive clasp, having a first clasp portion coupled to said first wrist band loop segment and a second clasp portion coupled to said second wrist band loop segment, for adjusting the length of the wrist band, and for providing electrical coupling between said first and second wrist band loop segments to from the wrist band loop antenna, said second clasp portion including a lower surface positioned substantially adjacent to and in contact with the wrist; and insulating means, coupled to said lower surface, for insulating said conductive clasp from the wrist when the device is attached to the wrist.

2. The wrist band loop antenna of claim 1, wherein said insulating means comprises:

a clasp insulator; and attachment means for attaching said clasp insulator to said conductive clasp.

3. The wrist band loop antenna of claim 2, wherein said clasp insulator is formed from a plastic material.

4. The wrist band loop antenna of claim 3, wherein said plastic material is molded to form the clasp insulator.

5. The wrist band loop antenna of claim 2 wherein said attachment means is an adhesive.

6. The wrist band loop antenna of claim 2 wherein said attachment means is an mechanical attachment.

7. The wrist band loop antenna of claim 1, wherein said conductive clasp is formed from sheet metal.

8. The wrist band loop antenna of claim 7, wherein said sheet metal is plated to prevent corrosion.

* * * * *